United States Patent [19]

Smith et al.

[11] Patent Number: 4,477,065

[45] Date of Patent: Oct. 16, 1984

[54] BELT FEED APPARATUS FOR CLOTH SPREADING MACHINE

[75] Inventors: Hoyt L. Smith; D. Frank Farrar, Jr., both of Nashville, Tenn.

[73] Assignee: Cutters Exchange, Inc., Nashville, Tenn.

[21] Appl. No.: 539,608

[22] Filed: Sep. 19, 1983

[51] Int. Cl.[3] ..... B65H 29/46

[52] U.S. Cl. ..... 270/31

[58] Field of Search ..... 270/31, 30

[56] References Cited

U.S. PATENT DOCUMENTS

| | | | |
|---|---|---|---|
| 2,478,840 | 8/1949 | Sayles | 270/31 |
| 3,645,524 | 2/1972 | Grimm et al. | 270/31 |
| 4,082,258 | 4/1978 | Smith | 270/31 |
| 4,092,020 | 5/1978 | Blessing | 270/31 |
| 4,262,893 | 4/1981 | Sgroi | 270/31 |
| 4,381,859 | 5/1983 | Jung et al. | 270/31 |

*Primary Examiner*—E. H. Eickholt

*Attorney, Agent, or Firm*—Harrington A. Lackey

[57] ABSTRACT

A cloth feed apparatus for a cloth spreading machine adapted to travel reciprocably and longitudinally over a cloth spreading table in order to spread successive layers of cloth, from a cloth supply roll mounted transversely of the machine. The cloth feed apparatus includes a first belt feeder device swingably mounted below the cloth supply roll and biased into constant engagement with the cloth roll for feeding a web of cloth from the roll. A second belt feeder device is mounted beneath the first belt feeder device for receiving a web of cloth from the first belt feeder device and for feeding the web to a discharge station at one end of the spreading machine for deposit upon the spreading table as the machine moves longitudinally of the table. The cloth feed apparatus made in accordance with this invention provides substantially tensionless feeding of the cloth web from the machine to the spreading table, and without the necessity of manually threading the cloth web on the machine. The cloth feed apparatus made in accordance with this invention is particularly adaptable for a turntable-type machine capable of two-way spreading, or, alternatively, one-way spreading.

13 Claims, 8 Drawing Figures

BELT FEED APPARATUS FOR CLOTH SPREADING MACHINE

BACKGROUND OF THE INVENTION

This invention relates to cloth spreading machines, and more particularly to a unique cloth feed apparatus for a cloth spreading machine.

Cloth spreading machines are well-known in the art in which a spreader frame supports a supply of cloth and reciprocably travels longitudinally of a spreading table for spreading layers of cloth upon a cutting or spreading table. The layers of cloth are subsequently cut into a plurality of patterns for various pieces of apparel or garments.

In cloth spreading machines supporting a cloth supply roll, the supply roll is sometimes supported upon the machine frame for free rotary movement and the web pulled from the supply roll by a positively driven cloth feed roll supported at one end of the machine. The positively driven cloth feed roller pulls the web from the large supply roll and feeds it down for deposit in layers upon the cutting or spreading table. Some examples of this type of cloth feeding arrangement are disclosed in the following U.S. Pat. Nos. 3,663,006, Benson et al, May 16, 1972, 3,727,907, Martin et al, Apr. 17, 1973, 3,735,223; Fort et al, May 22, 1973.

Another mechanism for feeding cloth from the supply roll to the cutting table includes two or more cloth feed rollers, which are positively driven, and which support the supply roll to feed a web of cloth across one or more guide bars or guide rollers for ultimate deposit upon the spreading table. Examples of this type of cloth support and feeding mechanism are shown in the following U.S. Pat. Nos. 2,276,479, Gilbert, Mar. 17, 1942, 3,400,927, Martin, Sr. et al, Sept. 10, 1968.

Examples of cloth supply rolls suspended in a cloth spreading machine by belt-type members are the Warth U.S. Pat. No. 185,371, Warth U.S. Pat. No. 207,575, and FIG. 4 of the Isaacs U.S. Pat. No. 1,265,452.

The Haberstump et al U.S. Pat. No. 2,118,556 discloses a cradle-type cloth supply roll support in which the supporting, positively driven, cloth supporting and feed rollers are connected by endless belts.

Some prior cloth spreading machines utilize a combination of both a positively driven set of cloth supporting rolls and a positively driven feed roll at one end of the spreading machine, as illustrated in U.S. Pat. No. 3,684,273 of Benson et al, issued Aug. 15, 1972.

The Sayles U.S. Pat. No. 2,478,840 discloses a cloth spreading machine adapted to support a cloth supply roll in a pair of opposed standards mounted upon a turntable. The cloth is fed from the supply roll by a cloth feed roller mounted on a pivotal arm and biased into tangential engagement with the surface of the supply roll. The cloth fed from the supply roll is then entrained over a forward positively driven roller for deposit upon the spreading table. Both the tangential cloth feed roller and the forward feed roller are driven in synchronism through a transmission chain of gears and sprockets from the wheel of the machine frame, so that the cloth can be fed at substantially the same linear speed as the movement of the spreader frame over the spreading table.

However, it is one characteristic of all of the spreading machines mentioned above, that after the cloth supply roll is mounted on the spreading machine, the cloth web from the roll must be manually threaded over the respective guide bars or forward feed rollers before the machine can commence movement to spread the layers of cloth.

Furthermore, in most cloth spreading machines, particularly machines in which the feed rolls must not only feed the peripheral web of cloth, but also support the weight of the cloth supply roll, tensionless cloth feeding has been difficult to obtain.

SUMMARY OF THE INVENTION

It is therefore an object of this invention to provide a unique type of cloth feed apparatus for a cloth spreading machine, in which improved tensionless cloth feeding is obtained so that catcher mechanisms for the cloth are not required. Another object is to provide a cloth feeding apparatus which is self-threading regardless of which end of the spreading machine constitutes the discharge or feeding end of the machine.

A further object of this invention is to provide a cloth spreading machine with a unique cloth feed apparatus in which the cloth may be spread in a face-to-face mode or a face-up or face-down mode, with a substantially tensionless cloth feed regardless of the mode.

Another object of this invention is to provide a cloth feed arrangement for a cloth spreading machine in which the feeding mechanism is in substantial continuous engagement with the cloth web from the time it leaves the cloth supply roll until it is discharged from one end of the spreading frame.

The cloth feeding mechanism made in accordance with this invention includes two pair of endless belt feeding devices arranged in sequence between the cloth supply roll and the cloth discharge end of the machine. The first belt device is pivotally mounted, and biased to swing into engagement with the periphery of the supply roll. The second belt feed device is mounted in a generally horizontal position beneath the discharge end of the first belt feed device and terminating at a discharge station at one end of the machine. The belts of the belt devices are driven at the same linear speed and in a direction for feeding a web of cloth from the supply roll to the discharge station. The first belt when it is driven, engages the periphery of the supply roll with an even pressure to feed the web from the roll downward until the web is deposited upon the second belt. The second, lower, belt carries the web the remaining length of the machine to the discharge station, where the web drops to the cutting or spreading table, usually through a spreader element mounted on the same end of the machine frame and adjacent the spread layers of cloth on the spreading table.

As the diameter of the roll is reduced by the unwinding of the cloth, the biased first belt continues to engage the peripheral web of the roll at substantially the same uniform pressure by virtue of its pivotal mounting and uniform biasing of the belt toward the roll.

In a preferred form of the invention, the cloth roll standards and belt feeding devices are mounted on a turntable rotatably supported upon the spreading machine. By appropriate programming of the drive mechanism, the first belt always moves in the same direction toward the second belt, and the second belt is selectively reversed for each rotation of the turntable, so that the cloth is always fed from the same end of the machine, regardless of the rotational attitude of the turntable. Thus, the belt feeding mechanism made in accordance with this invention is as easily adaptable to a cloth spreading machine for spreading cloth in a face-to-face mode or a face-up or face-down mode.

Moreover, because of the special arrangement of the two belt feed devices, once the cloth supply roll is mounted on the standards, no manual threading of the cloth from the roll to the discharge station or spread element of the machine, is required. The rotary movement of the belts automatically threads and feeds the cloth from the supply roll to the discharge station.

The belt feed devices utilized in the cloth feed apparatus of this invention provide greater surface contact between the feed mechanism and the cloth web from the supply roll to the discharge station.

It has also been found that the use of torsion bars for biasing the upper belt feed device into engagement with the periphery of the cloth supply roll, provides a more uniform pressure than other types of springs or biasing means utilized in previous tangential supply roll feeding devices.

The cloth feed apparatus for a cloth spreading machine made in accordance with this invention is equally effective in winding cloth, as in unwinding and spreading.

DESCRIPTION OF THE PREFERRED EMBODIMENT

Figures 1, 2:
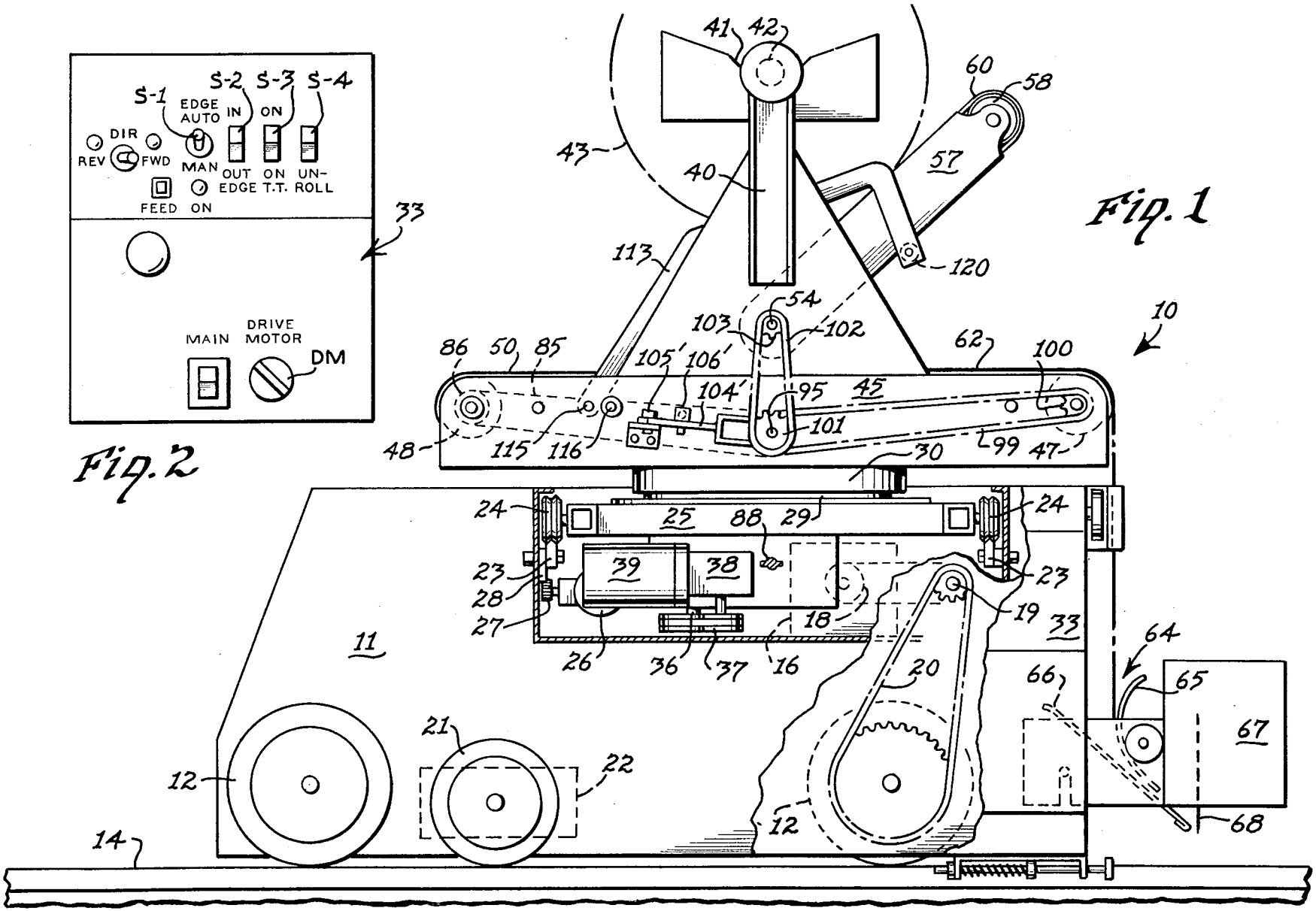
FIG. 1 is a right side elevational view of a cloth spreading machine incorporating a cloth feed apparatus made in accordance with this invention, with portions of the main frame shown in section taken along the line 1—1 of FIG. 3.
FIG. 2 is an enlarged face view of the control panel.
Figures 3, 6, 7, 8:
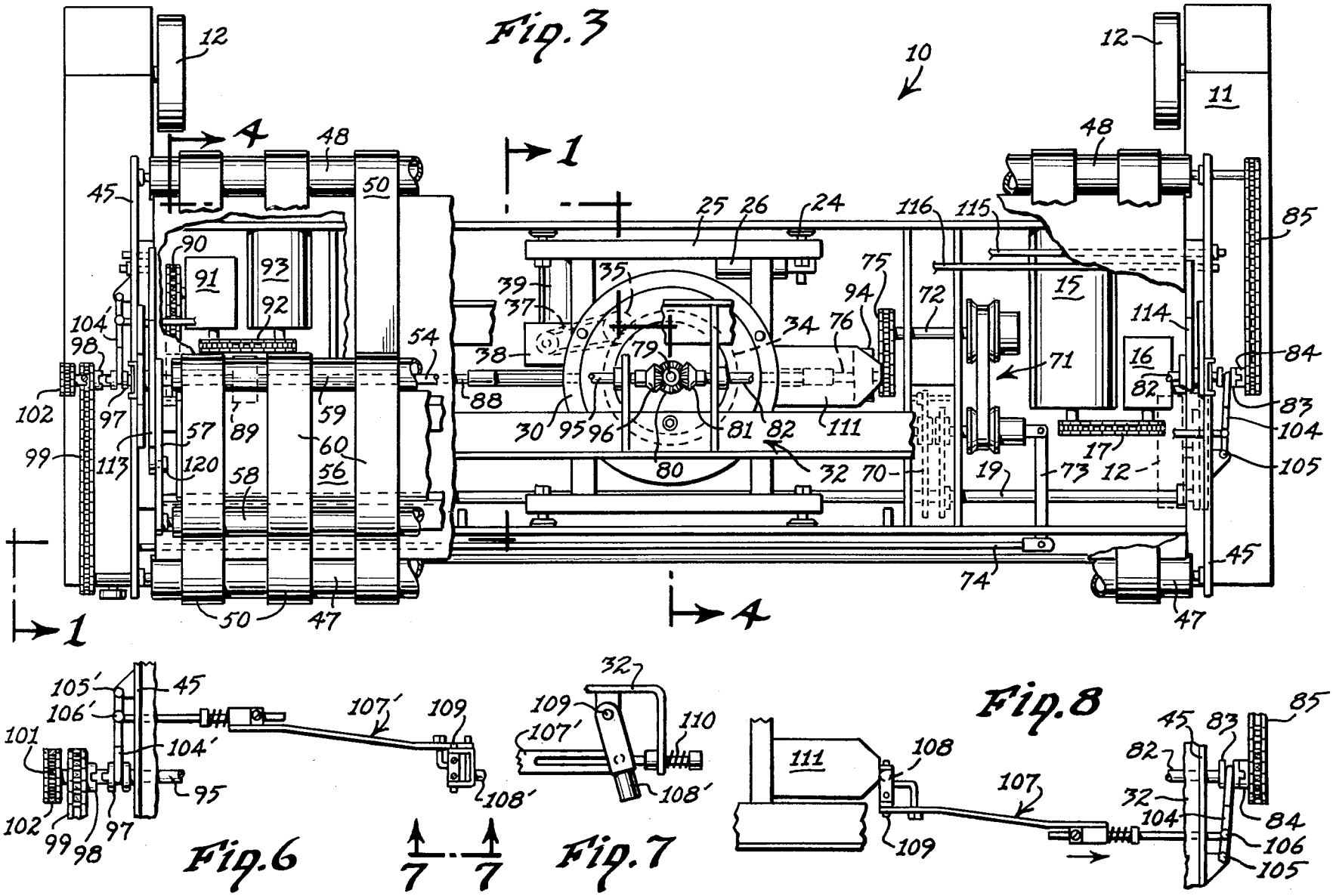
FIG. 3 is a top plan view of the spreading machine disclosed in FIG. 1, with portions broken away.
FIG. 6 is a fragmentary top plan view of the clutch linkage for driving the lower belt feed device in one direction, showing the clutch drive disengaged.
FIG. 7 is an enlarged fragmentary front elevational view of the pivotal cam roller, taken along the line 7—7 of FIG. 6.
FIG. 8 is a fragmentary plan view of a second clutch linkage for driving the lower belt feed device in the opposite direction from that disclosed in FIG. 6, showing the clutch drive engaged.
Figure 5:
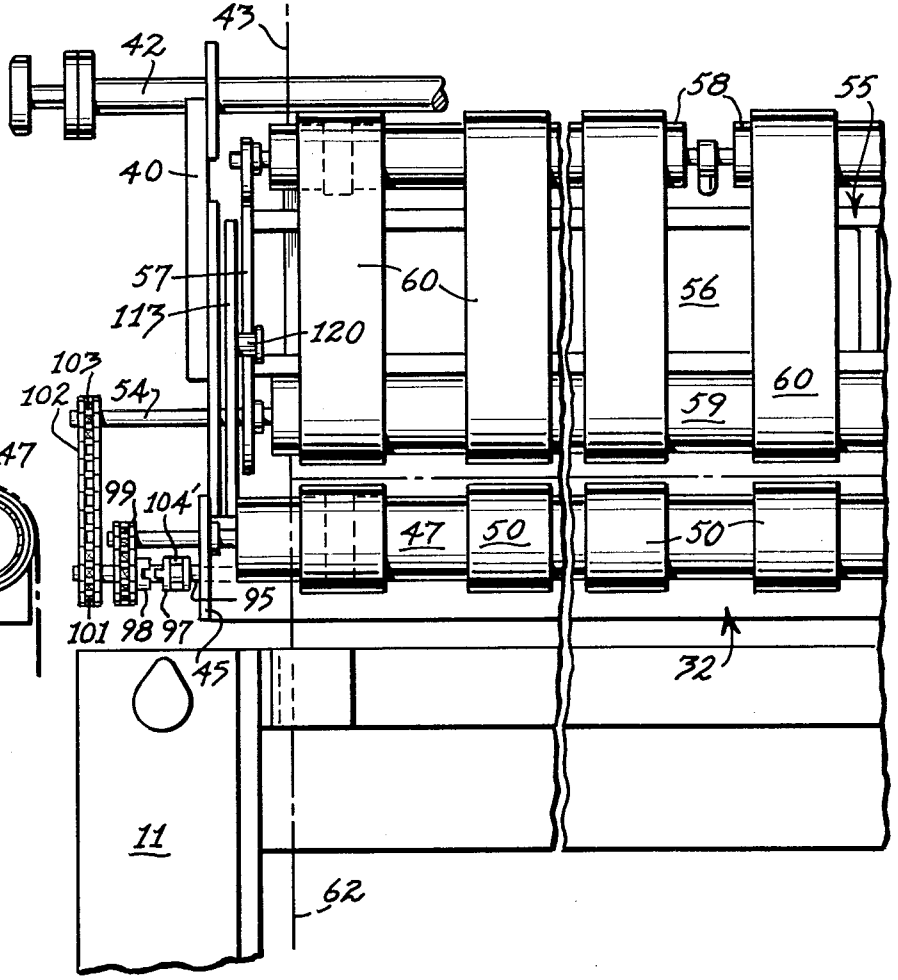
FIG. 5 is a fragmentary front elevational view of the machine as disclosed in FIG. 4.

Referring now to the drawings in more detail, FIGS. 1 and 3 disclose a cloth spreading machine 10 including a machine frame or spreader frame 11 supported by wheels 12 for reciprocable longitudinal movement along a spreading table 14.

A main drive motor 15 (FIG. 3) drives a gear reducer 16 through a sprocket-and-chain transmission 17. The gear reducer 16 in turn is connected through a sprocket-and-chain transmission 18 to the main drive shaft 19, which extends transversely of the machine frame 11. As best disclosed in FIG. 1, the main drive shaft 19 is connected through sprocket-and-chain transmissions 20 to both front wheels 12. The main drive motor 15 is reversible so that the machine frame 11 may be driven either forward (toward the right of FIG. 1), or rearward (toward the left of FIG. 1).

A rotary sensing wheel 21 may be utilized to sense the number of revolutions, and therefore the linear distance of travel desired, and to feed this information into a counting apparatus of a microcomputer 22. The microcomputer 22 automatically programs the length of travel of the machine 10, and automatically actuates stop controls and/or reverse controls for controlling the movement of the machine 10 over the table 14.

Mounted to extend transversely of the machine frame 11 are a pair of parallel tracks 23 supporting wheels 24 of a transversely movable carriage frame 25.

Suspended from the carriage frame 25 is a carriage motor 26 driving a pinion 27 engaging an elongated transversely extending rack 28. The carriage motor 26 is reversible to provide movement of the carriage 25 in either transverse direction in response to appropriate electrical signals from a conventional edge control sensor, not shown, or manual controls actuated by the switches S-1 and S-2 on the control panel 33.

Fixed to the top of the carriage 25 is a bearing cylinder 29 telescopingly receiving thereover a second rotary bearing cyliner 30. The bearing cylinder 30 rotates relative to the bearing cylinder 29 through the ball bearings 31. Fixed to the top of the rotary bearing cylinder 30 is a turntable member or frame 32.

Figure 4:
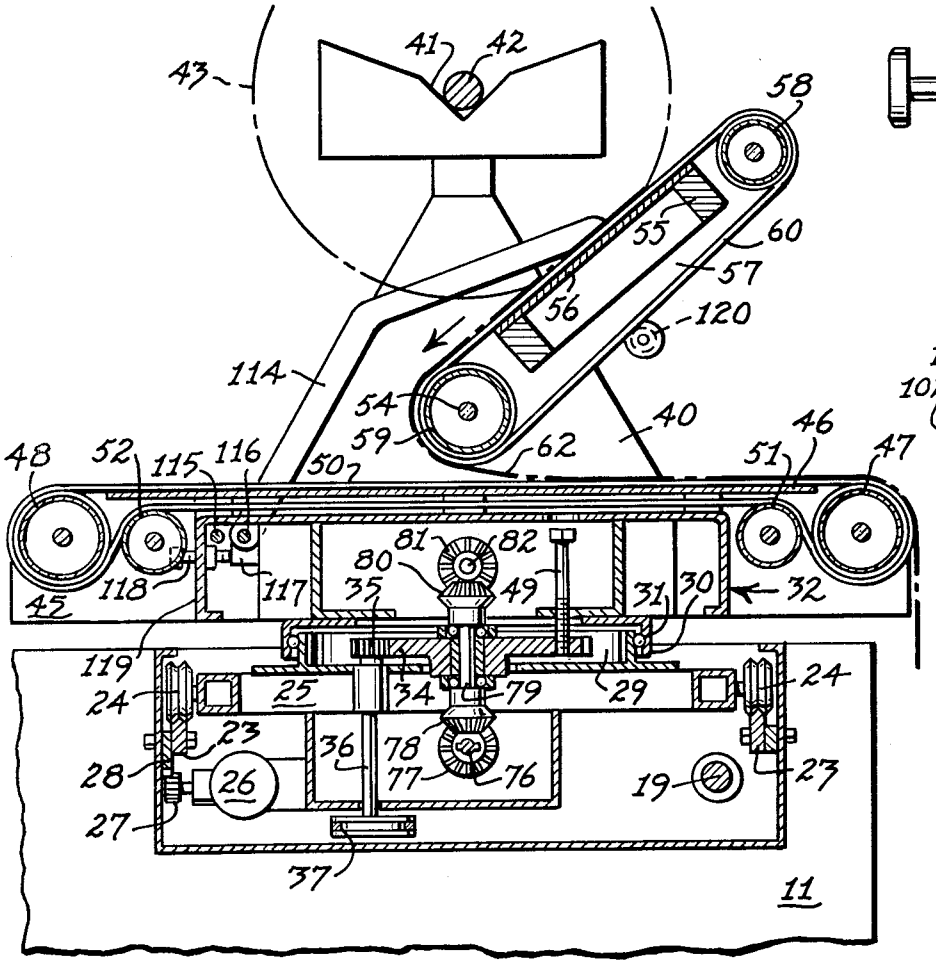
FIG. 4 is a fragmentary sectional elevation taken along the line 4—4 of FIG. 3.

A rotary gear 34, fixed to the turntable member 32 by bolts 49, engages a pinion 35 fixed on the upper end of a shaft 36 (FIG. 4). The lower end of the shaft 36 is connected through a belt-and-pulley transmission 37 to a gear reduction 38 driven by the turntable motor 39 (FIG. 1).

Projecting upward from opposite sides of the turntable frame 32 are a pair of upright, or vertically extending, standards 40 having upper notches 41 therein for receiving the opposite ends of the spindle 42 of a cloth supply roll 43.

Fixed at the opposite ends of the turntable frame 32 are a pair of side frames or flanges 45. Extending transversely between the upper edge portions of the side flanges 45 is an elongated belt-supporting platform 46. Rotatably mounted between the opposite end portions of the opposed side flanges 45 and adjacent the front and rear edges of the platform 46, is, respectively, a front belt feed roller 47 and a rear belt feed roller 48. A plurality of spaced belts 50 are trained over the belt feed rollers 47 and 48 and also about the idler rollers 51 and 52, to guide the lower legs of the belts 50 between the framework of the turntable member 32 and the lower surface of the platform 46, as best disclosed in FIG. 4.

Mounted for pivotal swinging movement toward and away from the cloth supply roll 43 about the rotary axis of a transverse driven shaft 54 journaled between the standards 40 is an upper belt feed frame 55. The upper belt feed frame 55 is also provided with an upper belt supporting platform 56. Extending transversely between the sidewalls 57 of the feed frame 55 are an upper belt feed roller 58 and a lower, or discharge, belt feed roller 59. Transversely spaced, endless, upper feed belts 60 are trained about the rollers 58 and 59, as best disclosed in FIG. 4.

As best disclosed in FIGS. 1 and 4, the lower discharge roller 59 supporting the upper feed belt 60 is mounted vertically above a portion of the lower belt 50, so that a web 62 of cloth engaged by the upper belt 60 will be fed downwardly by the belt 60 from the cloth supply roll 43, and deposited directly upon the lower belt 60. If, the lower belt 50 is moving forward, that is toward the right of FIGS. 1 and 4, the web 62 will be carried forward and over the forward belt roller 47. The web 62 then drops by gravity through the spreader element 64, between the guide flanges 65 and 66, and is deposited directly upon the spreading table 14. If desired, the spreader element 64 may also be provided with a cutter box 67 having a rotary cutter blade 68 for transversely cutting the cloth, in a well-known manner, particularly for one-way, or face-up or face-down, spreading.

Operatively connected to the main drive shaft 19, as disclosed in FIG. 3, is a conventional compensator device 70, which in turn is connected to a variable speed pulley device 71, for driving an output shaft 72 at variable speeds and in the same rotary direction. The variable speed pulley device 71 is controlled through link arm 73 to a laterally shiftable control rod 74, which may be manipulated from the near, or operator's side of the machine 10.

The output shaft 72 is connected through chain-and-sprocket transmission 75 to the primary drive feed shaft 76.

As best disclosed in FIG. 4, the inner end of the primary drive feed shaft 76 terminates in a bevel gear 77 which meshes at right angles with a lower bevel gear 78 at the bottom end of a vertical gear shaft 79. The upper end of the vertical gear shaft 79 terminates in an upper bevel gear 80, which in turn meshes at right angles with a bevel gear 81 forming the inner end of a transverse first driven feed shaft 82. The first driven feed shaft 82 is journaled for rotary movement transversely of the turntable member 32. The outer end of the first driven feed shaft 82 carries an axially shiftable clutch member 83 adapted to selectively engage a floating drive sprocket 84 carrying an endless chain 85 trained about a driven sprocket 86 fixed to the shaft of the rear belt roller 48, as best disclosed in FIGS. 1 and 3.

Extending in coaxial alignment with the primary drive feed shaft 76 toward the opposite side of the machine is a secondary drive feed shaft 88, journaled for free rotary movement within the turntable frame 32. The inner end of the secondary drive feed shaft 88 terminates in a bevel gear, not shown, opposing and identical to the bevel gear 77, and also meshing with the lower gear 78. Thus, rotary movement of the primary drive shaft 76 causes simultaneous rotary movement of the secondary drive shaft 88 in the opposite direction from the shaft 76.

The outer end portion of the secondary drive feed shaft 88 carries an electromagnetic clutch member 89, shown in hidden lines in FIG. 3, and connected through a chain-and-sprocket transmission 90 to the gear reducer 91. The gear reducer 91 is driven through a chain-and-sprocket transmission 92 by the auxiliary drive motor 93.

Another electromagnetic clutch 94 (FIG. 3) couples the primary drive feed shaft 76 to the chain-sprocket transmission 75. The controls for the machine 10 are programmed to energize the clutch 94 for driving the primary drive feed shaft 76, and simultaneously to de-energize the clutch 89 for disconnecting the auxiliary motor 93 and the secondary drive feed shaft 88. When the machine 10 is stationary and the switch S-4 is actuated, the auxiliary motor 93 and the magnetic clutch 89 are energized and the magnetic clutch 94 is de-energized simultaneously, to drive the secondary drive feed shaft 88 and to disable the primary drive feed shaft 76.

Rotatably mounted in the turntable frame 32 and in coaxial alignment with the first driven feed shaft 82 is a second driven feed shaft 95. The inner end of the second driven feed shaft 95 terminates in a bevel gear 96 meshing with the upper gear 80 on the opposite side from the miter gear 81 of the first driven feed shaft 82. Thus, the upper gear 80 on the gear shaft 79 drives the first driven feed shaft 82 in one rotary direction and the second driven feed shaft 95 in the opposite direction, simultaneously.

The outer end portion of the second driven feed shaft 95 also carries an axially shiftable rotary clutch member 97 adapted to selectively engage a floating sprocket 98. The floating sprocket 98 is coupled to the front belt feed roller 47 through the chain 99 and the sprocket 100 (FIG. 1).

Fixed to the free end of the second driven feed shaft 95 is a lower sprocket 101 carrying a chain 102 trained about an upper sprocket 103 which is fixed to the upper belt feed shaft 54. Thus, the upper feed belt 60 is driven continuously in the same direction by the second driven feed shaft 95 through the transmission 101, 102, 103 and the shaft 54, regardless of the rotary position of the turntable member 32.

As best disclosed in FIGS. 3 and 8, the axially shiftable clutch member 83 is operatively engaged by a yoke member 104 pivotally connected by pin 106 to a link member 107, which in turn is pivotally connected to a cam roller member 108. The cam roller member 108 is pivotally connected by pin 109 to a position of the turntable frame 32. The cam roller member 108 is biased radially inwardly toward the center of the turntable frame 32 by a spring member 110 (FIG. 7).

Mounted in a fixed position adjacent the central portion of the turntable member 32 is a radially extending cam plate 111 (FIGS. 3 and 8). As the turntable frame 32 is rotated about its vertical rotary axis, which is coincidental with the rotary axis of the vertical gear shaft 79, the spring-biased cam roller member 108 is biased radially inward to cause the clutch member 83 also to shift inwardly and thereby disengage the clutch sprocket 84. However, when the turntable frame 32 is rotated to the position disclosed in FIG. 3, with the drive clutch sprocket 84 on the opposite side of the machine from the operator's side, the cam roller 108 engages the cam surface of the cam plate 111, causing the cam roller member 108 to move radially outward, thereby shifting the axially movable clutch member 83 into operative engagement with the clutch sprocket 85. Thus, the rear belt roller 48 is placed in driving engagement with the vertical gear shaft 79.

The axially shiftable clutch member 97 on the opposite side of the turntable 32 is connected by a yoke member 104′ and link member 107′ through pivot pins 105° and 106′ to a cam roller member 108′ of identical construction to the corresponding parts on the opposite side of the turntable frame 32. Thus, when the turntable frame 32 is rotated 180° to the opposite side of the machine, the cam roller member 108′ will engage the cam plate 111 to cause the axially shiftable clutch member 97 to engage the driven clutch sprocket 98, thereby placing the front belt roller 47 into driving engagement with the vertical gear shaft 79, when the front belt roller 47 is located in the rear of the machine.

Thus, regardless of which clutch sprocket 84 or 98, is in operative driving engagement with the drive train, the lower belt member 50, albeit selectively driven in reverse directions for each reversal of the turntable frame 32, will always be moving forward, relative to the machine frame 11.

The vertical gear shaft 79 is driven either through the primary drive feed shaft 76 from the main drive motor 15 when the machine frame 11 is moving longitudinally over the table 14, or the gear shaft 79 is driven from the secondary drive feed shaft 88, from the auxiliary motor 93, when the machine frame 11 is stopped in a stationary position relative to the spreading table 14. The auxiliary motor 93 may be driven in either direction, in order to either wind or unwind a cloth web 62 upon the supply roll 43.

The upper belt member 60 is continually biased into engagement with the periphery of the cloth supply roll 43 by means of a pair of pivotal arms 113 and 114. The lower end of the proximal pivotal arm 113 (FIG. 1) is fixed to the proximal end of an elongated torsion bar 115, which extends transversely across the turntable frame 32. The remote end of the torsion bar 115 is journaled in the opposite end of the turntable frame 32.

The pivotal end of the remote pivot arm 114 is fixed to the remote end of a second elongated torsion bar 116 which extends transversely of the turntable frame 32. The proximal end of the torsion bar 116 is pivotally journaled in a side portion of the turntable frame 32, and is also fixed to a depending abutment block 117 (FIG. 4). An elongated threaded bolt 118 extends through a turntable frame member 119 for abutment against the depending abutment block 117. Thus, by adjusting the bolt 118, the torsional forces on the torsion bar 116 may be increased or decreased, to provide the desired biasing pressure of the upper belt member 60 against the cloth supply roll 43. The remote end of the torsion bar 115 is also preferably fixed to an abutment block, not shown, similar to the abutment block 117, and provided with an adjustment bolt similar to the bolt 119 in order to adjust the torsional forces in the torsion bar 116.

The pivotal arms 113 and 114 extend upward and forwardly and terminate in roller bearings 120 adapted to engage the bottom edges of the side flanges 45. The roller bearings 120 thus permit relative movement between the pivotal arms 113 and 114 and the upper belt frame 55 as the frame 55 moves toward and away from the cloth supply roll 43 in response to decrease or increase in the diameter of the cloth roll 43.

It has been found that the utilization of the transversely extending torsion bars 115 and 116 to provide the biasing pressure for the upper belt member 60, is preferred over other types of biasing means, such as springs, since the torsion bars provide more even pressure against the outer periphery of the cloth supply roll 43 than other known biasing means.

Because of the softness of the fabric in the web material on the cloth supply roll 43, because of the flexibility of the endless belt 60, and because a belt 60 is utilized instead of a single roller, there is a substantial area of contact between the belt 60 and the outer periphery of the cloth supply roll 43, which would not be obtained by a single roller.

In operation of the machine 10, the turntable frame 32 is normally located in a rotary position relative to the machine frame 11 so that the upper belt 60 is inclined upward and forwardly of the machine, as disclosed in FIGS. 1 and 4. Although the belt 60 can feed a cloth web 62 from the front or the rear of the cloth supply roll 43, nevertheless, when the belt 60 is disposed in front of the supply roll 43, loading of the supply roll 43 is facilitated from the rear of the machine 10. Thus, the loading of the supply roll 43 from the rear will not interfere with the cloth web 62 normally disposed in front of the machine, nor the stack of spread cloth layers, not shown, on the spreading table 14.

When the machine 10 is utilized in a face-to-face, or two-way, spreading mode, the supply roll 43 is loaded on the cradle notches 41, and the auxiliary motor 93 is manually energized, while the machine 10 is stationary, to feed a cloth web 62 down to the spreader element 64. This web 62 is initially fed by the belt 60, which moves the web 62 downward until it is deposited upon the forward moving lower belt 50. The web 62 is then directed forwardly and over the top of the front belt roller 47 until the web 62 is guided between the flanges 65 and 66 to a position adjacent to or directly upon the spreading table 14. The auxiliary motor 19 is energized by the manual switch S-4 (FIG. 2), which is pushed downward to its "unroll" position.

The drive motor switch button DM is then energized to cause the machine frame 10 to move forward over the spreading table 14. Simultaneously with the movement of the frame 11, cloth from the supply roll 43 is fed through the spreader element 64 by the bolt 60 and 50 to cause the cloth to be laid at substantially the same speed as the longitudinal movement of the frame 11, thereby creating a tensionless web of fabric as it is laid on the spreading table 14. At the end of the longitudinal traverse of the frame 11, the microcomputer 22 programs the controls to reverse the movement of the frame 11, creating a transverse fold at the forward end of the fabric layer, and causing the machine 10 to continue to spread cloth in the reverse direction. This operation is repeated at the end of each programmed traverse of the machine to continually lay one layer of cloth upon another, face-to-face, with alternate folded ends.

In order for the machine 10 to operate in the face-down or face-up, or one-way spreading mode, the controls for the machine energize the main drive motor 15 to actuate the wheels 12 to move the frame 11 forward down the spreading table 14. However, when the forward end of the traverse is completed, instead of the microcomputer 22 reversing the movement of the frame 11, it causes the frame 11 to stop, by de-energizing the motor 15. A travelling cutter blade, such as the blade 68 in the cutter box 67 is then caused to move transversely of the machine, in a well known manner to cut the end of the fabric laid upon the table 14.

The operator then pushes the switch S-3 (FIG. 2) to cause the turntable motor 39 to rotate the turntable frame 32 through 180°, thereby placing the upper belt member 60 to the rear of the cloth supply roll 43, but still in engagement with the supply roll 43.

As previously described, through the operation of the cam roller members 108 and 108' with the cam plate 111, the direction of the lower belt 50 is reversed so that it will continue to feed the cloth web 62 forward, even though the turntable frame 32 is in its reverse position. As previously described, the upper belt member 60 will continually feed the cloth web 62 in the same downward direction, regardless of whether the belt 60 is in front of the cloth supply roll 43, or engaging the supply roll 43 in the rear.

The cloth spreader controls then cause the machine 10 to move in its reverse direction, spreading cloth in the same reverse direction, but laying the cloth web 80 so that its face has the same orientation as the face of the previously spread cloth layer.

After the machine 10 completes its rearward traverse, the machine 10 is stopped, the cloth is cut, the turntable 32 rotated and the motion of the machine 10 is then resumed forward to spread the next layer of cloth, in the same manner as previously described.

It is therefore apparent from the above description of the invention, that a cloth spreading machine 10 has been produced which has the versatile capability of spreading cloth in a two-way mode or a one-way mode, and with the same advantage for either mode, of feeding the cloth from the supply roll 43 without the necessity of manually threading the cloth, and with greater control of the cloth feeding. By virtue of the arrangement of the upper belt 60 and the lower belt 50 on the cloth spreading machine 10, the control of the feeding of the cloth is so complete that substantially tensionless feeding and laying of the cloth is effected. In the utilization of the spreading machine 10 is either the two-way or the one-way mode, no catcher mechanisms of any type are required.

What is claimed is:

1. In a cloth spreading machine including an elongated machine frame movable longitudinally reciprocably over a spreading table and having opposite ends, a cloth feed apparatus, comprising:

(a) standard means on the machine frame adapted to support a cloth supply roll in a mounted position transversely of said frame for free rotary movement, (b) first belt feeder means comprising a first feeder frame, (c) said first belt feeder means further comprising a first endless belt carried on said feeder frame for longitudinal movement relative to said first feeder frame, (d) pivot means pivotally mounting said first feeder frame relative to said standard means for swinging movement of said first belt toward and away from engagement with a supply roll in said mounted position, (e) said first belt having a discharge end for discharging a web of cloth from said first belt, (f) second belt feeder means comprising a second feeder frame below said first feeder frame, (g) a second endless belt carried on said second feeder frame for longitudinal movement relative to said second feeder frame, a portion of said second belt being located vertically below said discharge end of said first belt, (h) said second belt having a discharge end adjacent one end of the machine frame for discharging a web of cloth carried by said second belt, from said discharge end of said second belt, (i) means biasing said first feed frame toward a cloth supply roll in mounted position to cause said first belt to engage the periphery of the cloth supply roll, (j) drive means to drive said first belt toward its discharge end and said second belt toward its discharge end.

2. The invention according to claim 1 in which said second belt has first and second opposite discharge ends, said drive means comprising means for selectively driving said second belt toward said first discharge end or toward said second discharge end.

3. The invention according to claim 2 further comprising a turntable member mounted for rotary movement about a vertical axis relative to the machine frame, said standard means, said first and second belt feeder means, said pivot means and said biasing means being mounted on said turntable member, said first and second discharge ends of said second belt being adapted to be alternately positioned in a single discharge station adjacent one end of the machine frame when said turntable member has been rotated through 180°.

4. The invention according to claim 3 in which said drive means comprises means for reversing the direction of said second belt in order to drive said belt alternately toward said first discharge station or said second discharge station, while continuously driving said first belt in the same direction towards its discharge end.

5. The invention according to claim 1 in which said drive means drives said first and second belts at the same linear speed.

6. The invention according to claim 1 in which said biasing means comprises a torsion bar having opposite free and fixed ends said fixed end being fixedly mounted relative to said frame and said free end being operatively connected to said first feeder frame.

7. The invention according to claim 6 in which said basing means further comprises a swing arm comprising a pivotal end and an operative end, said operative end operatively engaging said first feeder frame, and said pivotal end being connected to the free end of said torsion bar, said torsion bar extending transversely of the machine frame, said fixed end of said torsion bar being fixed in a position transversely on the opposite side of the machine frame from said free end.

8. The invention according to claim 4 in which said drive means comprises main drive means for moving the elongated machine frame longitudinally reciprocably over a spreading table, belt transmisson means for driving said first belt continuously in the same direction and for selectively driving said second belt in a direction towards said discharge station, regardless of the rotary position of said turntable member.

9. The invention according to claim 8 further comprising means for coupling said main drive means to said belt transmission means for driving said belts when the elongated frame is moving over the spreading table, and for uncoupling said main drive means from said belt transmission means when the machine frame is stationary relative to said table.

10. The invention according to claim 9 further comprising, auxiliary belt drive means adapted to be coupled to said belt transmission means when said main drive means is uncoupled from said belt transmission means in order to drive said belts when the elongated frame is stationary relative to the table.

11. The invention according to claim 4 further comprising a spreader element on the machine frame beneath said discharge station for guiding a web of cloth from said discharge station to a laying position on a spreading table over which the machine frame is longitudinally moving.

12. The invention according to claim 4 in which said drive means further comprises means for reversing the drive of said first and second belts to cause a web of cloth carried by said first and second belts to wind about a cloth supply roll in said mounted position.

13. The invention according to claim 4 further comprising clutch means for automatically reversing the drive direction of said second belt during rotation of said turntable member end-for-end.

* * * * *